US006311627B1

(12) United States Patent
Draper et al.

(10) Patent No.: US 6,311,627 B1
(45) Date of Patent: Nov. 6, 2001

(54) ARTICLE WRAPPING TABLE ASSEMBLY

(76) Inventors: John D. Draper; Jane A. Draper, both of 180 Meadow La., Collinsville, VA (US) 24078

( * ) Notice: Subject to any disclaimer, the term of this patent is extended or adjusted under 35 U.S.C. 154(b) by 0 days.

(21) Appl. No.: 09/569,629

(22) Filed: May 12, 2000

(51) Int. Cl.[7] ..... A47B 37/00

(52) U.S. Cl. ..... 108/50.11; 108/50.17; 312/237; 83/614

(58) Field of Search ..... 83/614; 108/28, 108/29, 50.11, 50.17, 125, 129; 312/237, 231

(56) References Cited

U.S. PATENT DOCUMENTS

| | | | | |
|---|---|---|---|---|
| 9,872 | * | 7/1853 | Hesse | 83/614 X |
| D. 329,944 | | 10/1992 | Longtin . | |
| D. 341,776 | | 11/1993 | Broyles . | |
| 560,294 | * | 5/1896 | Black | 83/614 X |
| 1,480,168 | * | 1/1924 | Lambert | 108/50.17 X |
| 2,174,613 | * | 10/1939 | Blaschke | 108/125 X |
| 2,715,558 | * | 8/1955 | Bell | 108/129 X |
| 3,727,868 | * | 4/1973 | Buchanan | 248/309 |
| 4,186,833 | | 2/1980 | Homan . | |
| 4,969,698 | | 11/1990 | Maynard, Jr. . | |
| 5,598,786 | | 2/1997 | Patterson . | |
| 5,680,973 | | 10/1997 | Vulpitta et al. . | |

* cited by examiner

*Primary Examiner*—Jose V. Chen
*Assistant Examiner*—Michael J. Fisher

(57) ABSTRACT

An article wrapping table assembly for facilitating the article wrapping process. The article wrapping table assembly includes a table that has a substantially planar upper surface, a plurality of table legs, a pair of extension portions and a cutting assembly. The extension portions are positioned adjacent to the upper surface of the table. Each extension portion has a cutout portion. The cutout portions are aligned with each other and designed to rotatably hold a roll of wrapping material. The cutting assembly is slidably engaged in a slot that runs across the upper surface of the table. The cutting assembly is used for cutting a selected amount of wrapping material that has been unrolled onto the upper surface of the table.

11 Claims, 2 Drawing Sheets

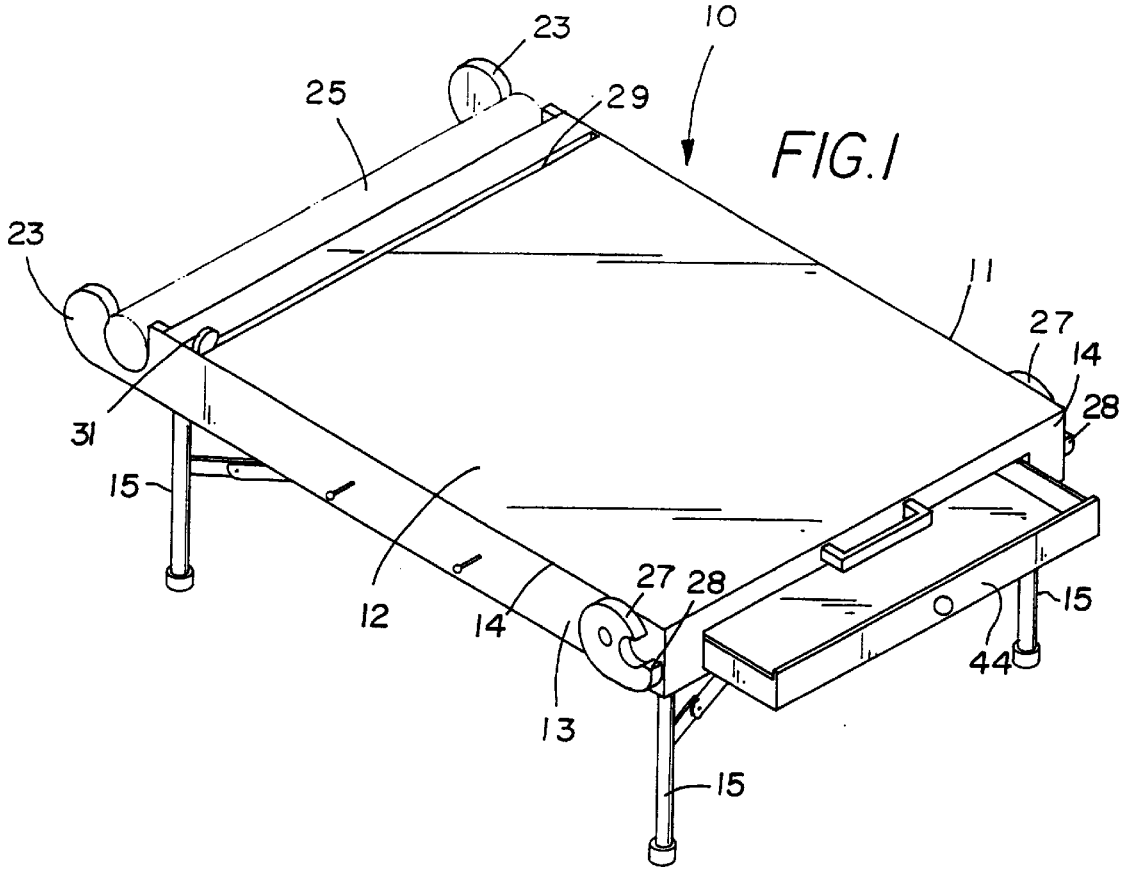
FIG.1
FIG.2
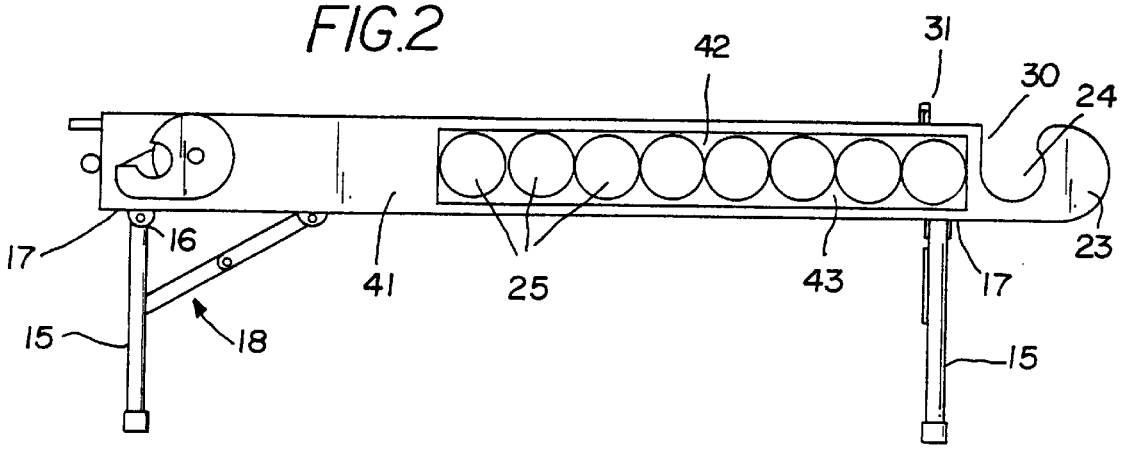

ARTICLE WRAPPING TABLE ASSEMBLY

BACKGROUND OF THE INVENTION

1. Field of the Invention

The present invention relates to utility tables and more particularly pertains to a new article wrapping table assembly for facilitating the article wrapping process.

2. Description of the Prior Art

The use of utility tables is known in the prior art. More specifically, utility tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,186,833; 4,969,698; U.S. Pat. No. Des. 341,776; U.S. Pat. Nos. 5,680,973; 5,598,786; and U.S. Pat. No. Des. 329,944.

While these devices fulfill their respective, particular objectives and requirements, the aforementioned patents do not disclose a new article wrapping table assembly. The inventive device includes a table that has a substantially planar upper surface, a plurality of table legs, a pair of extension portions and a cutting assembly. The extension portions are positioned adjacent to the upper surface of the table. Each extension portion has a cutout portion. The cutout portions are aligned with each other and designed to rotatably hold a roll of wrapping material. The cutting assembly is slidably engaged in a slot that runs across the upper surface of the table. The cutting assembly is used for cutting a selected amount of wrapping material that has been unrolled onto the upper surface of the table.

In these respects, the article wrapping table assembly according to the present invention substantially departs from the conventional concepts and designs of the prior art, and in so doing provides an apparatus primarily developed for the purpose of facilitating the article wrapping process.

SUMMARY OF THE INVENTION

In view of the foregoing disadvantages inherent in the known types of utility tables now present in the prior art, the present invention provides a new article wrapping table assembly construction wherein the same can be utilized for facilitating the article wrapping process.

The general purpose of the present invention, which will be described subsequently in greater detail, is to provide a new article wrapping table assembly apparatus and method which has many of the advantages of the utility tables mentioned heretofore and many novel features that result in a new article wrapping table assembly which is not anticipated, rendered obvious, suggested, or even implied by any of the prior art utility tables, either alone or in any combination thereof.

To attain this, the present invention generally comprises a table that has a substantially planar upper surface, a plurality of table legs, a pair of extension portions and a cutting assembly. The extension portions are positioned adjacent to the upper surface of the table. Each extension portion has a cutout portion. The cutout portions are aligned with each other and designed to rotatably hold a roll of wrapping material. The cutting assembly is slidably engaged in a slot that runs across the upper surface of the table. The cutting assembly is used for cutting a selected amount of wrapping material that has been unrolled onto the upper surface of the table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new article wrapping table assembly apparatus and method which has many of the advantages of the utility tables mentioned heretofore and many novel features that result in a new article wrapping table assembly which is not anticipated, rendered obvious, suggested, or even implied by any of the prior art utility tables, either alone or in any combination thereof.

It is another object of the present invention to provide a new article wrapping table assembly that may be easily and efficiently manufactured and marketed.

It is a further object of the present invention to provide a new article wrapping table assembly that is of a durable and reliable construction.

An even further object of the present invention is to provide a new article wrapping table assembly which is susceptible of a low cost of manufacture with regard to both materials and labor, and which accordingly is then susceptible of low prices of sale to the consuming public, thereby making such article wrapping table assembly economically available to the buying public.

Still yet another object of the present invention is to provide a new article wrapping table assembly which provides in the apparatuses and methods of the prior art some of the advantages thereof, while simultaneously overcoming some of the disadvantages normally associated therewith.

Still another object of the present invention is to provide a new article wrapping table assembly for facilitating the article wrapping process.

Yet another object of the present invention is to provide a new article wrapping table assembly which includes a table that has a substantially planar upper surface, a plurality of table legs, a pair of extension portions and a cutting assembly. The extension portions are positioned adjacent to the upper surface of the table. Each extension portion has a cutout portion. The cutout portions are aligned with each other and designed to rotatably hold a roll of wrapping material. The cutting assembly is slidably engaged in a slot that runs across the upper surface of the table. The cutting assembly is used for cutting a selected amount of wrapping material that has been unrolled onto the upper surface of the table.

Still yet another object of the present invention is to provide a new article wrapping table assembly that conveniently stores wrapping supplies in one location.

Even still another object of the present invention is to provide a new article wrapping table assembly that is easy to use.

These together with other objects of the invention, alone with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new article wrapping table assembly according to the present invention.

FIG. 2 is a schematic side view of the present invention.

DESCRIPTION OF THE PREFERRED EMBODIMENT

Figure 3:
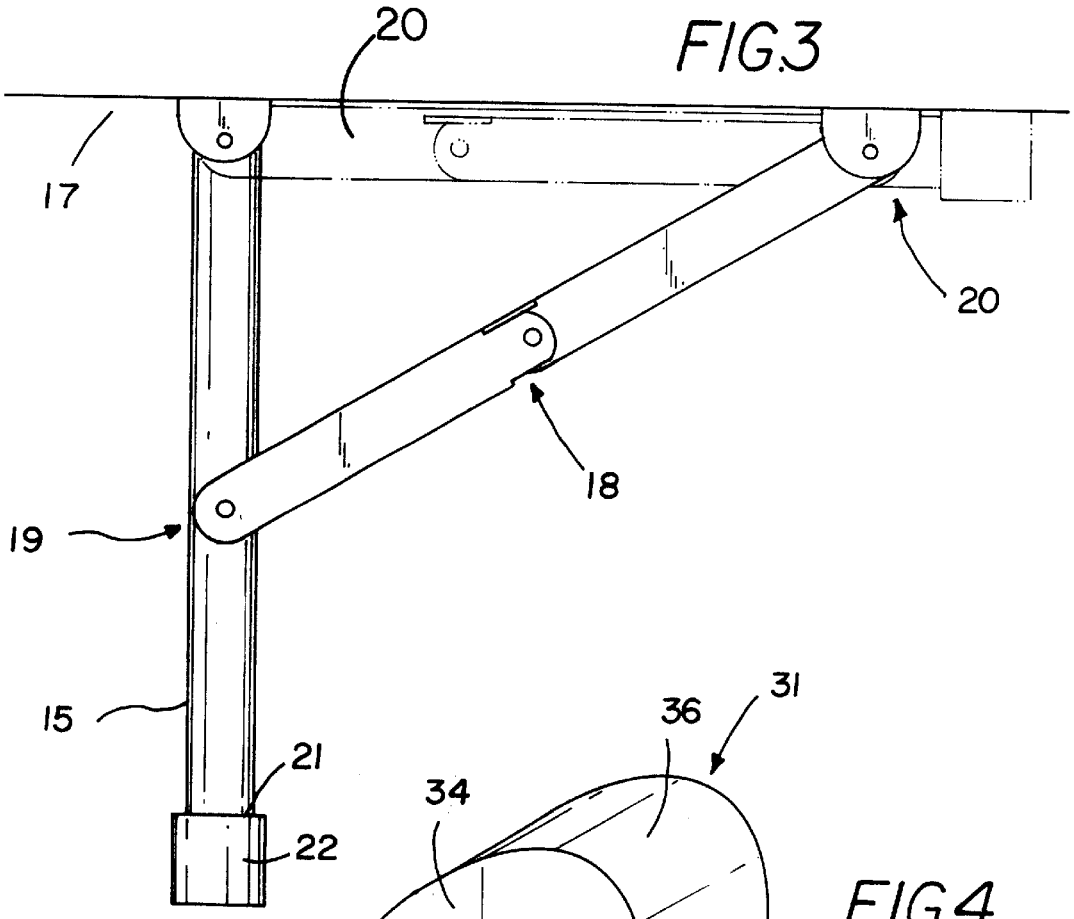
FIG. 3 is a schematic side view of the present invention, illustrating the folding leg assemblies.
Figure 4:
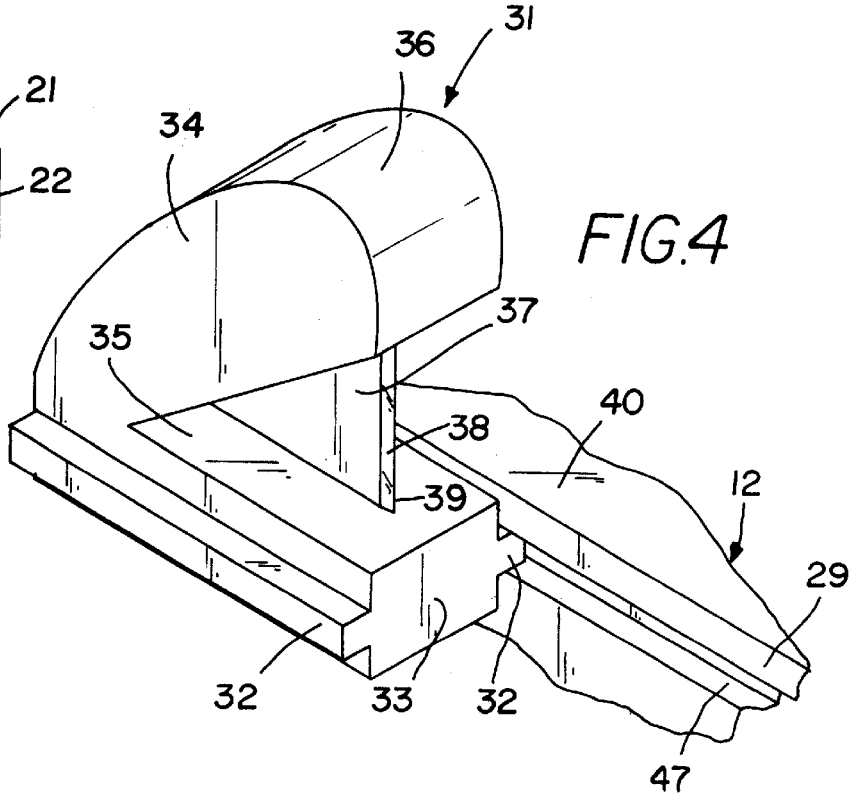
FIG. 4 is a schematic perspective view of the present invention, illustrating the cutting assembly.

With reference now to the drawings, and in particular to FIGS. 1 through 4 thereof, a new article wrapping table assembly embodying the principles and concepts of the present invention and generally designated by the reference numeral 10 will be described.

As best illustrated in FIGS. 1 through 4, the article wrapping table assembly 10 generally comprises a table 11 that has a substantially planar upper surface 12. A first side wall 13 and a second side wall 41 extend downward from opposite sides of the upper surface 12. Moreover, a first end wall 14 and a second end wall 30 extend downward from opposite ends of the upper surface 12.

The proximal end 16 of a plurality of table legs 15 are pivotally coupled to a lowermost surface 17 of the table 11. Each of the table legs 15 is extendable to support the table 11. A plurality of folding leg support assemblies 18 extend between an associated one of the table legs 15 and the lowermost surface 17 of the table 11. Each leg support assembly 18 is designed to lock an associated table leg 15 in an extended position 19 when the table leg is extended to support the table 11. When the table assembly 10 is not being used, each of the table legs 15 may be placed in a retracted position 20 to minimize the space needed for storage. The distal end 21 of each of the table legs 15 are covered by a respective rubber member 22. The rubber member 22 prevents damage to a surface on which the table legs 15 are placed.

Both the first side wall 13 and the second side wall 41 of the table 11 have an extension portion 23. The extension portions 23 extend outward from opposite ends of the second end wall 30 of the table 11. Each extension portion 23 has a cutout portion 24. The cutout portions 24 are aligned with each other and are designed for receiving a roll of wrapping material 25. The longitudinal axis of the roll of wrapping material 25 is positioned perpendicular to a longitudinal axis of the upper surface 12 of the table 11. The cutout portions 24 have a rounded lower edge 46 for permitting rotation of the roll of wrapping material 25. Thus the wrapping material 25 may be dispensed across the upper surface 12 of the table 11.

The table assembly 10 has a pair of pegs 26 that extend from the first side wall 13 of the table 11 for facilitating hanging bags of decorative materials for coupling to a wrapped article. In addition, a tape dispenser 27 is coupled to the first side wall 13 and the second side wall 41. Each of the tape dispensers 27 have a tape cutting portion 28 that is substantially aligned with a face of the first end wall 14.

A slot 29 extends across the upper surface 12 of the table 11. The slot runs parallel the second end wall 30 of the table 11. A cutting assembly 31 is slidably coupled to the slot 29 in the upper surface 12 of the table 11. The cutting assembly 31 has main body 33. A pair of tongues 32 extend outward from opposite sides of the main body 33. The main body of the cutting assembly 31 is positioned in the slot 29 in the table. Each tongue 32 that extends from the main body is slidably inserted into a respective groove 47 in the slot 29. Thus the main body 33 of the cutting assembly 31 is slidable in the slot 29.

The cutting, assembly 31 also includes an upper portion 34 that has a triangular notch 35 therein. The upper portion 34 has a rounded upper surface 36 for facilitating comfortable grasping of the cutting assembly 31. A blade 37 that has a sharpened edge 38 faces an opening of the notch 35. A lowermost edge 39 of the sharpened edge 38 extends below the upper surface 12 of the table 11. The blade 37 is positioned for cutting, wrapping material 25 that is positioned on the upper surface 12 of the table 11 by sliding the cutting assembly 31 in the slot 29 across the upper surface 12 of the table 11.

A storage compartment 42 extends into the second side wall 41 of the table 11. The second side wall 41 has an opening 43 into the storage compartment 42. The storage compartment 42 is designed for holding a plurality of rolls of wrapping material 25. A drawer 44 is positioned to be extendable from the first end wall 14 of the table 11. In addition, a carrying handle 45 extends from the first end wall 14 for facilitating transportation of the table 11.

In use, a roll of wrapping material 25 is removed from the storage compartment 42 and inserted in the cutout portions 24 in the extension portions 23 of the table assembly 10. A selected amount of wrapping material 25 is unraveled from the roll and placed on the upper surface 12 of the table 11. The cutting assembly 31 is then slid in the slot 29 across the upper surface 12 of the table 11 thereby cutting the selected amount of wrapping material 25. The wrapping material 25 may then be used to wrap an article.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A table assembly for facilitating wrapping of articles, said table assembly comprising:

a table having a upper surface, a pair of side walls extending downwardly from opposite side edges of said upper surface, and a pair of end walls extending downwardly from opposite end edges of said upper surface;

a plurality of table legs coupled to said table; each of said side walls of said table having an extension portion, said extension portions extending outwardly from opposite ends of one of said end walls of said table, each extension portion having a cutout portion for receiving a roll of wrapping material such that the wrapping material is dispensable across the upper surface of the table;

said upper surface of said table having a slot extending across said upper surface parallel to one of said end walls of said table;

a cutting assembly slidably coupled in said slot for cutting the wrapping paper;

said cutting assembly including an upper portion having a rounded upper surface for facilitating comfortable grasping of said cutting assembly;

said upper portion of said cutting assembly having a notch therein, said notch extending between a pair of side faces of said upper portion of said cutting assembly; and a blade having a sharpened edge facing an opening of said notch, a lowermost edge of said sharpened edge extending below a face of said upper surface whereby said blade is positioned for cutting wrapping material positioned on said upper surface of said table by sliding said cutting assembly in said slot across said upper surface of said table, said blade being positioned between said side faces of said upper portion of said cutting assembly such that said side faces are adapted for inhibiting inadvertent striking of a hand of a user by said blade.

2. The table assembly for facilitating wrapping of articles of claim 1 further comprising:

said cutting assembly having a pair of tongues extending outwardly from opposite sides of a main body of said cutting assembly; and each of said tongues being slidably inserted into a respective groove in said slot whereby said main body of said cutting assembly is slidable in said slot.

3. The table assembly for facilitating wrapping of articles of claim 1 further comprising:

said cutout portions having a rounded lower edge for permitting rotation of the roll of wrapping material.

4. The table assembly for facilitating wrapping of articles of claim 1 further comprising:

said table legs being pivotally coupled to the lowermost surface of said table, each of said table legs being extendable to support said table; and a plurality of folding leg support assemblies, each leg support assembly being coupled to extend between an associated one of said table legs and said table.

5. The table assembly for facilitating wrapping of articles of claim 1 further comprising:

said table legs having a distal end, said distal end of said table legs being covered by a respective rubber member for preventing damage to a surface on which the table legs are placed.

6. The table assembly for facilitating wrapping of articles of claim 1 further comprising:

a drawer positioned to be extendable from a first one of said end walls of said table.

7. The table assembly for facilitating wrapping of articles of claim 1 further comprising:

a pair of pegs extending from a first one of the side walls of the table for facilitating hanging bags of decorative materials for coupling to a wrapped article.

8. The table assembly for facilitating wrapping of articles of claim 1 further comprising:

a pair of tape dispensers, each tape dispenser being coupled to a respective one of said pair of side walls, each of said tape dispensers having a tape cutting portion positioned substantially aligned with a face one of said end walls opposite send extension portions.

9. The table assembly for facilitating wrapping of articles of claim 1 further comprising:

a carrying handle extending from one of said end walls opposite said extension portions for facilitating transportation of said table.

10. The table assembly for facilitating wrapping of articles of claim 1 further comprising:

a storage compartment extending into a second one of said side walls of said table, said second side wall having an opening into said storage compartment, said storage compartment being adapted for holding a plurality of rolls of wrapping material.

11. A table assembly for facilitating wrapping of articles, said table assembly comprising:

a table having a substantially planar upper surface, a pair of side walls extending downwardly from opposite side edges of said upper surface, and a pair of end walls extending downwardly from opposite end edges of said upper surface;

a plurality of table legs each having a proximal end pivotally coupled to a lowermost surface of said table, each of said table legs being extendable to support said table;

a plurality of folding leg support assemblies, each leg support assembly being coupled to extend between an associated one of said table legs and said table;

a distal end of each of said table legs being covered by a respective rubber member for preventing damage to a surface on which the table legs are placed;

a drawer positioned to be extendable from a first one of said end walls of said table;

each of said side walls of said table having an extension portion, said extension portions extending outwardly from opposite ends of a second one of said end walls of said table, each extension portion having a cutout portion, said cutout portions being aligned such that said cutout portions are adapted for receiving a roll of wrapping material such that a longitudinal axis of the roll of wrapping material is positioned perpendicular to a longitudinal axis of said upper surface of said table, said cutout portions having a rounded lower edge for permitting rotation of the roll of wrapping material whereby the wrapping material is dispensable across the upper surface of the table;

a pair of pegs extending from a first one of the side walls of the table for facilitating hanging bags of decorative materials for coupling to a wrapped article;

a pair of tape dispensers, each tape dispenser being coupled to a respective one of said pair of side walls, each of said tape dispensers having a tape cutting portion positioned substantially aligned with a face of said first end wall;

a carrying handle extending from said first end wall for facilitating transportation of said table;

said upper surface of said table having a slot extending across said upper surface parallel to said second end wall of said table;

a cutting assembly coupled to said table, said cutting assembly having a pair of tongues extending outwardly from opposite sides of a main body of said cutting assembly, said main body of said cutting assembly being positioned in said slot in said table, each of said tongues being slidably inserted into a respective groove in said slot whereby said main body of said cutting assembly is slidable in said slot;

said cutting assembly including an upper portion having a triangular notch therein, said upper portion having a rounded upper surface for facilitating comfortable grasping of said cutting assembly said notch extending between a pair of side faces of said upper portion of said cutting assembly;

a blade having a sharpened edge facing an opening of said notch, a lowermost edge of said sharpened edge extending below a face of said upper surface whereby said blade is positioned for cutting wrapping material positioned on said upper surface of said table by sliding said cutting assembly in said slot across said upper surface of said table, said blade being positioned between said side faces of said upper portion of said cutting assembly such that said side faces are adapted for inhibiting inadvertent striking of a hand of a user by said blade; and a storage compartment extending into a second one of said side walls of said table, said second side wall having an opening into said storage compartment, said storage compartment being adapted for holding a plurality of rolls of wrapping material.

* * * * *